United States Patent [19]

Trotta

[11] 4,184,246

[45] Jan. 22, 1980

[54] SHAVING UNIT

[75] Inventor: Robert A. Trotta, Winthrop, Mass.

[73] Assignee: The Gillette Company, Boston, Mass.

[21] Appl. No.: 927,481

[22] Filed: Jul. 24, 1978

[51] Int. Cl.[2] ..... B26B 21/22

[52] U.S. Cl. ..... 30/47; 30/50

[58] Field of Search ..... 30/32, 47, 77, 346.59

[56] References Cited

U.S. PATENT DOCUMENTS

| | | | |
|---|---|---|---|
| 614,049 | 11/1898 | Greenfield | 30/346.59 X |
| 2,776,478 | 1/1957 | Mercer | 30/61 |
| 3,178,814 | 4/1965 | Craig | 30/62 |
| 3,657,810 | 4/1972 | Nissen | 30/63 |
| 3,675,322 | 7/1972 | Perry | 30/32 |
| 3,871,077 | 3/1975 | Nissen | 30/77 X |
| 4,012,837 | 3/1977 | Ascoli | 30/43.92 X |
| 4,063,354 | 12/1977 | Oldroyd | 30/47 |

*Primary Examiner*—Gary L. Smith

*Attorney, Agent, or Firm*—Richard A. Wise; Scott R. Foster

[57] ABSTRACT

A shaving unit having blade means exposed forwardly of an overlying cap member and rearwardly of a guard member, wherein the blade means and guard member are movable in unison and relative to the cap means, the guard member having fixed thereto a leaf spring to provide a resilient restoring force in response to forces transmitted to the unit during a shaving operation.

4 Claims, 2 Drawing Figures

SHAVING UNIT

BACKGROUND OF THE INVENTION

1. Field of the Invention

This invention relates to shaving units and is directed more particularly to a shaving unit having a cutting edge exposed forwardly of an overlying cap member and rearwardly of a guard member.

2. Description of the Prior Art

U.S. Pat. No. 4,063,354 issued Dec. 20, 1977 to B. Oldroyd, et al shows a shaving unit having a cap member permanently joined to a first platform member with blade means and guard means slidably movable therebetween to alter the shaving geometry of the unit during a shaving operation. As described in the U.S. Pat. No. 4,063,354, there may be provided a spring means within the shaving unit to afford a resilient restoring force on the blade and guard in response to forces transmitted to the unit during the shaving operation.

SUMMARY OF THE INVENTION

An object of the present invention is to improve the Oldroyd invention by means of providing a leaf spring means permanently fixed to the blade and guard unit, which spring provides a resilient restoring force responsive to forces transmitted to the unit during a shaving operation.

With the above and other objects in view, as will hereinafter appear, a feature of the present invention is the provision of a shaving unit comprising cap means, first platform means, the cap means being permanently joined to the first platform means, the first platform means having a connector portion for connection of the unit to a razor handle, blade means, and guard means, the guard means comprising a guard portion for engaging the skin ahead of a cutting edge of the blade means and a second platform portion, the guard portion extending from the second platform portion, the blade means and the guard portion being permanently joined and disposed between the cap means and the first platform means, the blade means and the second platform portion being slidably movable in unison relative to and between the cap means and the first platform means, and a leaf spring fixed to the second platform portion and engageable with a rear wall of the shaving unit to provide a resilient restoring force in response to forces transmitted to the unit during shaving.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
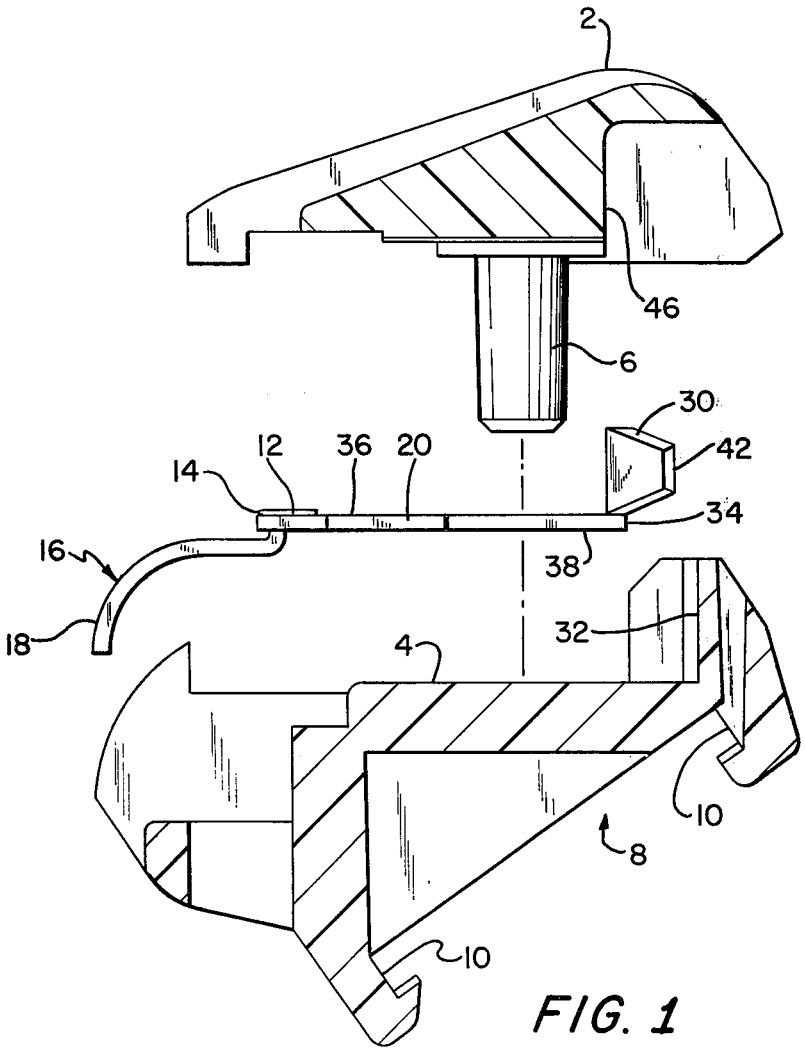
FIG. 1 is an exploded side elevational view, partly in section, of one form of shaving unit illustrative of an embodiment of the invention.

Referring to FIG. 1, it will be seen that the illustrative shaving unit includes a cap means 2 permanently joined to a first platform means 4, as by expansion of rivetlike extensions 6. The first platform means 4 is provided with a connector portion 8, as for example opposed grooves 10, for connection of the unit to a razor handle (not shown).

The shaving unit further includes blade means 12 having a cutting edge 14, the blade means being permanently fixed to a guard means 16. The guard means 16 comprises a guard portion 18 for engaging the skin ahead of the cutting edge 14 of the blade means 12. The guard means 16 further includes a second platform portion 20. The guard portion 18 extends from the second platform portion 20. The blade means 12 and the guard means 16 are permanently joined together and are disposed between the cap means 2 and the first platform means 4, the blade means and the second platform portion being movable in unison relative to and between the cap means and the first platform means.

A leaf spring 30 is fixed to the second platform portion 20 and is engageable with a rear wall 32 of the shaving unit to provide a resilient restoring force in response to forces transmitted to the shaving unit during a shaving operation.

Figure 2:
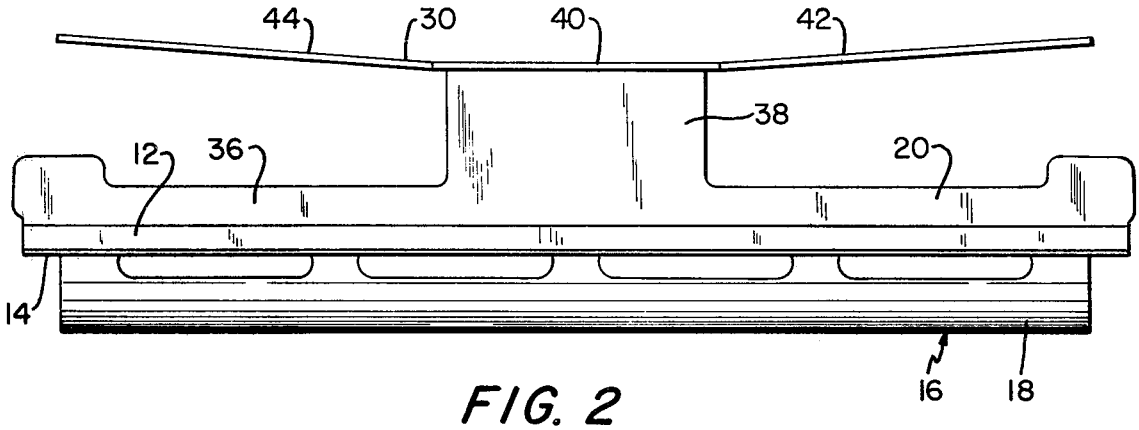
FIG. 2 is a top plan view of a portion of the shaving unit.

As may be seen in FIG. 1, the leaf spring 30 upstands from the second platform portion 20 proximate a rearward edge 34 of the second platform portion. Preferably, the second platform portion 20 includes a blade-support portion 36, which is generally coextensive with the blade means, as may be seen in FIG. 2. The second platform portion 20 further includes a spring support portion 38, the spring support portion 38 extending rearwardly from a central portion of the blade support portion 36. The aforementioned leaf spring 30 upstands from the rearward edge 34 of the spring support portion 38.

The leaf spring 30 includes a central generally rigid portion 40 and a flexible wing portion 42, 44 extending from either side thereof. The central portion 40 is fixed to the spring support portion, and the wing portions 42,44 are angled toward the rear wall 32.

A forward wall 46 of the blade unit provides a stop means for limiting forward movement of the blade means and second platform portion. Thus, the leaf spring 30 is disposed in a chamber formed by the forward wall 46 and the rear wall 32, the walls serving to limit the extent to which the blade and guard means 16 are able to move.

In operation, if the guard portion 18 is pressed with excessive force against a surface being shaved, such force will overcome the force of the leaf spring 30 and the combination blade means 12 and guard means 16 will slide between the cap means 2 and the first platform means 4 rearwardly in response to such force until such force is relaxed and/or the force of the leaf spring wing portions 42, 44 react against the rear wall 32 so as to return the guard portion 18 and the blade means 12 to their normal position. Thus, if undue pressure is applied to the razor by an operator, the blade means 12 is moved rearwardly to a safer position, i.e., a position more sheltered by the guard portion 18 and cap means 2.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A shaving unit comprising cap means, first platform means, said cap means being permanently joined to said first platform means, said first platform means having a connector portion for connection of said unit to a razor handle, blade means, and guard means, said guard means comprising a guard portion for engaging the skin ahead of a cutting edge of said blade means and a second platform portion, said guard portion extending from said second platform portion, said blade means and said guard means permanently joined and disposed between said cap means and said first platform means, said blade means and said second platform portion being slidably movable in unison relative to and between said cap means and said first platform means, and a leaf spring fixed to said second platform portion proximate a rearward edge of said second platform portion and upstanding therefrom, said unit having an internal forward wall and an internal rear wall forming a chamber, said leaf spring being disposed in said chamber and engaged with said rear wall of said unit to provide a resilient restoring force in response to forces transmitted to said unit during shaving, said forward and rear walls providing stop means for limiting the movement of said leaf spring and thereby said guard means and said blade means.

2. A shaving unit in accordance with claim 1 in which said second platform portion includes a blade support portion generally coextensive with said blade means, and a spring support portion, said spring support portion extending rearwardly from a central portion of said blade support portion, said leaf spring being fixed to said spring support portion and upstanding from said spring support portion proximate a rearward edge of said spring support portion.

3. A shaving unit in accordance with claim 2 in which said leaf spring includes a central generally rigid portion and a flexible wing portion extending from either side thereof, said central portion being fixed to said spring support portion, said wing portions being angled toward said rear wall.

4. A shaving unit comprising cap means, first platform means, said cap means being permanently joined to said first platform means, said first platform means having a connector portion for connection of said unit to a razor handle, blade means, and guard means, said guard means comprising a guard portion for engaging the skin ahead of a cutting edge of said blade means and a second platform portion, said guard portion extending from said second platform portion, said second platform portion including a blade support portion generally coextensive with said blade means, and a spring support portion, said spring support portion extending rearwardly from a central portion of said blade portion, said blade means and said guard means being permanently joined and disposed between said cap means and said first platform means, said blade means and said second platform portion being slidably moveable in unison relative to and between said cap means and said first platform means, and a leaf spring fixed to said spring support portion, said leaf spring upstanding from said spring support portion proximate a rearward edge of said spring support portion, said leaf spring including a central generally rigid portion and a flexible wing portion extending from either side thereof, said central portion being fixed to said spring support portion, said unit having an internal forward wall and an internal rear wall forming a chamber, said leaf spring being disposed in said chamber and engaged with said rear wall of said unit to provide a resilient restoring force in response to forces transmitted to said unit during shaving, said forward and rear walls providing stop means for limiting the movement of said leaf spring and thereby said guard means and said blade means.

* * * * *